US005436814A

United States Patent [19]

Hanley

[11] Patent Number: 5,436,814

[45] Date of Patent: Jul. 25, 1995

[54] RARE GAS ILLUMINATED SAFETY FLARE

[75] Inventor: Earl Hanley, Lyndhurst, N.J.

[73] Assignee: Brite-Glow Industries, Inc., Island Heights, N.J.

[21] Appl. No.: 185,133

[22] Filed: Jan. 24, 1994

Related U.S. Application Data

[63] Continuation-in-part of Ser. No. 59,462, May 11, 1993, abandoned.

[51] Int. Cl.[6] ..... F21L 5/00

[52] U.S. Cl. ..... 362/216; 362/109; 362/183; 362/186; 362/205; 362/222; 362/265; 362/390; 340/321

[58] Field of Search ..... 362/102, 109, 157, 183, 362/186, 194, 196, 205, 216, 221, 222, 223, 263, 265, 369, 390; 340/321

[56] References Cited

U.S. PATENT DOCUMENTS

| | | | |
|---|---|---|---|
| 3,920,981 | 11/1975 | Bailey | 362/216 |
| 4,345,305 | 8/1982 | Kolm et al. | 362/222 |
| 4,782,432 | 11/1988 | Coffman | 362/157 |
| 4,866,849 | 9/1989 | Parra | 362/109 |
| 4,885,670 | 12/1989 | Baake | 362/216 |
| 5,079,679 | 1/1992 | Chin-Fa | 362/102 |
| 5,134,558 | 7/1992 | Williams et al. | 362/216 |
| 5,203,624 | 4/1993 | Schier et al. | 362/183 |
| 5,400,008 | 3/1995 | Toohey | 340/321 |

FOREIGN PATENT DOCUMENTS

| | | | |
|---|---|---|---|
| 335381 | 2/1959 | Switzerland | 362/222 |
| 449810 | 7/1936 | United Kingdom | 362/216 |

*Primary Examiner*—Stephen F. Husar
*Assistant Examiner*—Alan B. Cariaso
*Attorney, Agent, or Firm*—Stephen W. White

[57] ABSTRACT

A portable, durable and rugged hand-held lighting device particularly useful as a safety flare or illumination device is described. This device utilizes a rare gas containing illumination source (e.g. a glass tube containing the rare gas) and is particularly useful in projecting light during darkness or in fog. The light source may be any of the conventional rare gas materials but neon is preferred. A fluorescent material coating the inside of the glass tube may be used enhance the output of the light from other rare gasses. The power supply for this unit may be replaceable or rechargeable batteries or the device may be connected to a permanent DC or AC power supply to enhance the life thereof. A transformer is used to increase the electrical power supply from the power supply to the glass tube and is required in order to get the high intensity light output afforded by the use of rare gas illuminating devices.

8 Claims, 6 Drawing Sheets

RARE GAS ILLUMINATED SAFETY FLARE

CROSS-REFERENCE TO RELATED APPLICATIONS

This invention is a Continuation-in-Part of my previously filed application U.S. Ser. No. 08/059,462, filed May 11, 1993, entitled "Neon Baton".

BACKGROUND OF THE INVENTION

1. Field of the Invention

This invention is related to lights used to illuminate an emergency scene and more specifically to a hand-held and portable lighting device that can be used as an emergency beacon, for example. Still more specifically, this invention relates to a hand-held, portable, emergency and safety lighting device that employs a rare gas illumination glass tube along with a fluorescent coating inside said tube to enhance the brilliance of the light produced therefrom. Even more specifically, this invention relates to a hand-held and portable emergency lighting device which can employ multiple power supplies to provide the power therefor.

2. Description of the Prior Art

There are a host of prior art elements used to provide portable and hand-held lighting for emergency uses. Some of these are simply incandescent light sources similar to the conventional flashlight and which may contain a semi-transparent housing which gives off a safety color or glow (e.g. red). Most of these prior art elements do not produce sufficient light to pierce the darkness of the night, especially in areas where there is some semblance of fog present.

There are a host of other safety lighting devices also known in the prior art. Some of these employ incandescent illumination sources, some employ high intensity flashers, such as strobes and the like, and still others employ some sort of rare gas containing light source. Most of these prior art elements are designed to be placed or fixed near where some emergency is taking place such as road work and the like. None of these are particularly designed to be hand-held and portable and none of these have a multiplicity of power sources associated therewith. Additionally, few of these prior art lighting devices are rugged enough to withstand continued use under difficulty circumstances.

The rare gases known in the prior art and used as a lighting source include neon, helium, argon, krypton, xenon and small amounts of mercury mixed with argon. The gases are usually placed within a glass tube along with a pair of electrodes, one electrode at each end of the glass tube. These rare gases, when exposed to or charged electrically, will produce a high intensity light. In order to produce the desired color of light, the tube may be first coated with a fluorescent coating to enhance the natural color which emanates from the rare gas. Then, the tube is filled with the rare gas of choice taken care to eliminate all other foreign elements within the tube. The tube is heated to convert the rare gas to a vapor and drive off the impurities. The heat drives off the impurities and the glass tube is vacuumed to remove the vapors. Once the tube has been freed of all impurities, it can be filled with the desired rare gas and sealed. When an electrical current is applied to the electrodes, a brilliant light is produced. The glass tube can be bent to any desired shape and even form decorative designs and letters. The rare gas containing light is used conventionally in advertising and the like since various colors can be produced therein. It is not particularly common to use rare gas light sources within portable, hand-held lighting devices.

It is also known in the prior art to use a neon-containing tube or an aligned strip of light emitting diodes as the light source in a multi-purpose, traffic director's stick. This element is by definition and utility, however, a longitudinal light source and thus there is a limit as to how much light can be emitted thereby. Additionally, the prior art discloses only batteries as a source of power and thus there is a conditional limitation to the use of this element.

SUMMARY OF THE INVENTION

There is a pressing need in the art for a utile, portable and hand-held, high intensity safety flare device that can be used to illuminate the scene of an accident or to provide emergency lighting and direction. There is also a pressing need in the art to provide such device which can use a multitude of power sources. There is also a pressing need for a safety light or flare that can be used over and over again and will illuminate through fog, rain darkness and gloom and one which is tough, durable and rugged. Thus, it is an object of this invention to solve the needs of the prior art and these and yet other objects are achieved in a transparent, portable, hand-held high intensity safety illumination device comprising an interconnected top housing unit and bottom housing unit, said top housing unit comprising a hollow, cylindrical housing for a rare gas illuminating source, said illuminating source having a glass tube containing said rare gas and wherein said glass tube is bent in a "U" shaped fashion with a top end and a bottom end, protective cushioning means surrounding said glass tube at said top and said bottom ends thereof, and wherein said bottom housing unit having a circuit means attached to said glass tube in said top unit, a power source connected with said circuit means, through a transformer means, and a switch means for activating said rare gas illuminating source through said circuit means and said power source wherein said rare gas is taken from a group consisting of neon, argon, krypton, and argon mixed with mercury.

DETAILED DESCRIPTION OF THE INVENTION

Figure 1:
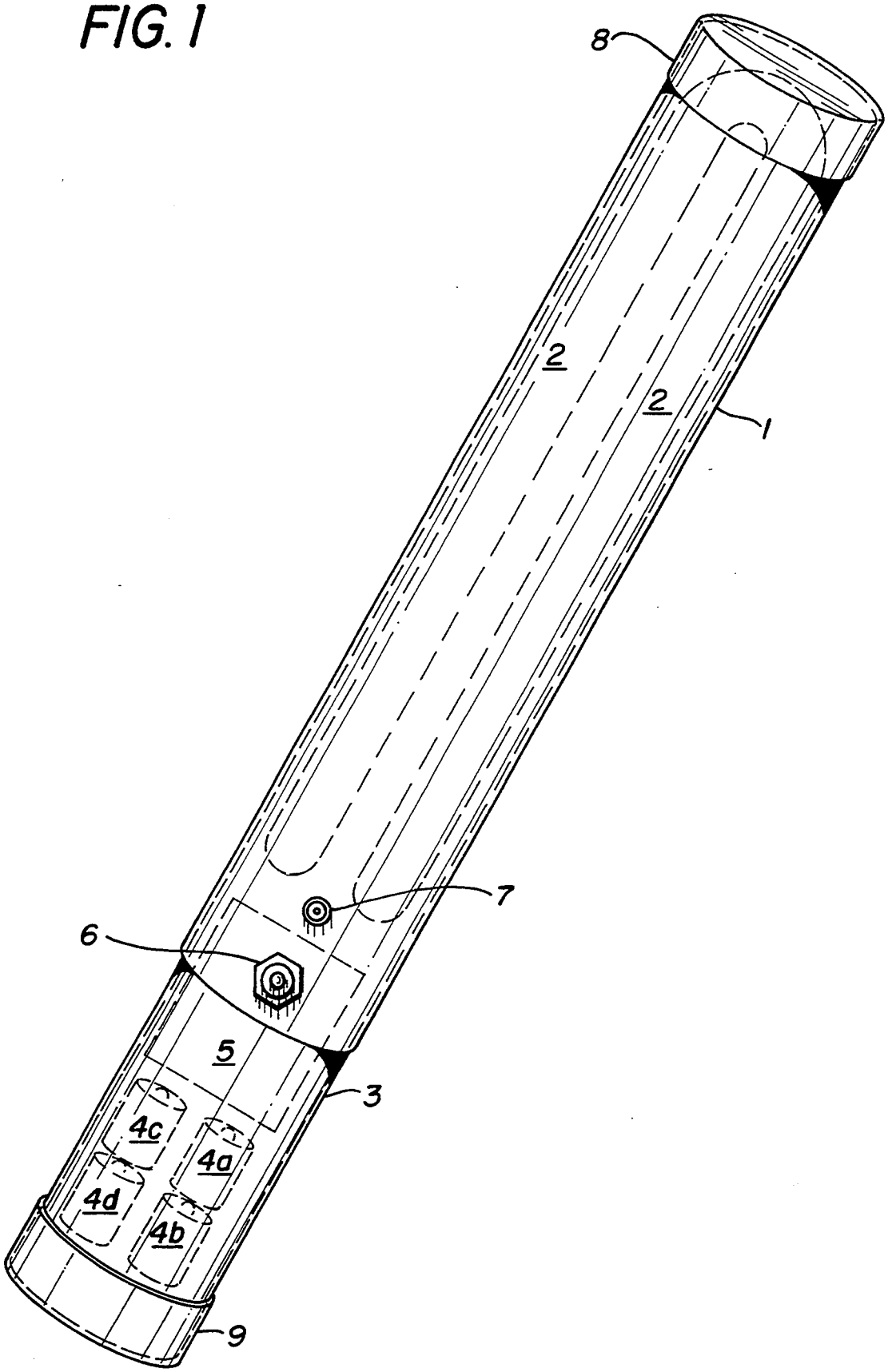
FIG. 1 is an overall showing of the hand-held, rare gas illuminating safety device of this invention.

Referring now specifically to the drawings, which demonstrate and show the utility as well as the preferred embodiments of this invention, FIG. I is an overall showing of the hand-held, rare gas illuminating safety device of this invention wherein 1 is the top housing unit which contains a "U" shaped, evacuated and rare gas containing glass tube 2. The top housing unit 1 is attached to a bottom housing unit 3. The bottom housing unit 3 contains a power supply which are shown as batteries (may be rechargeable) 4*a*, 4*b*, 4*c*, and 4*d*, in this particular mode. This power supply is connected through an interior circuitry (not shown) to a transformer 5. The transformer 5 is further connected through switching means 6 (off, on or flashing) to electrodes in the rare gas containing illumination source 2 (also not shown in this drawing). A power jack 7 is preferentially provided so as to either effect DC or AC power to the unit or to recharge the batteries. A top cap 8 and a bottom cap 9 are also shown in this figure.

Figure 2:
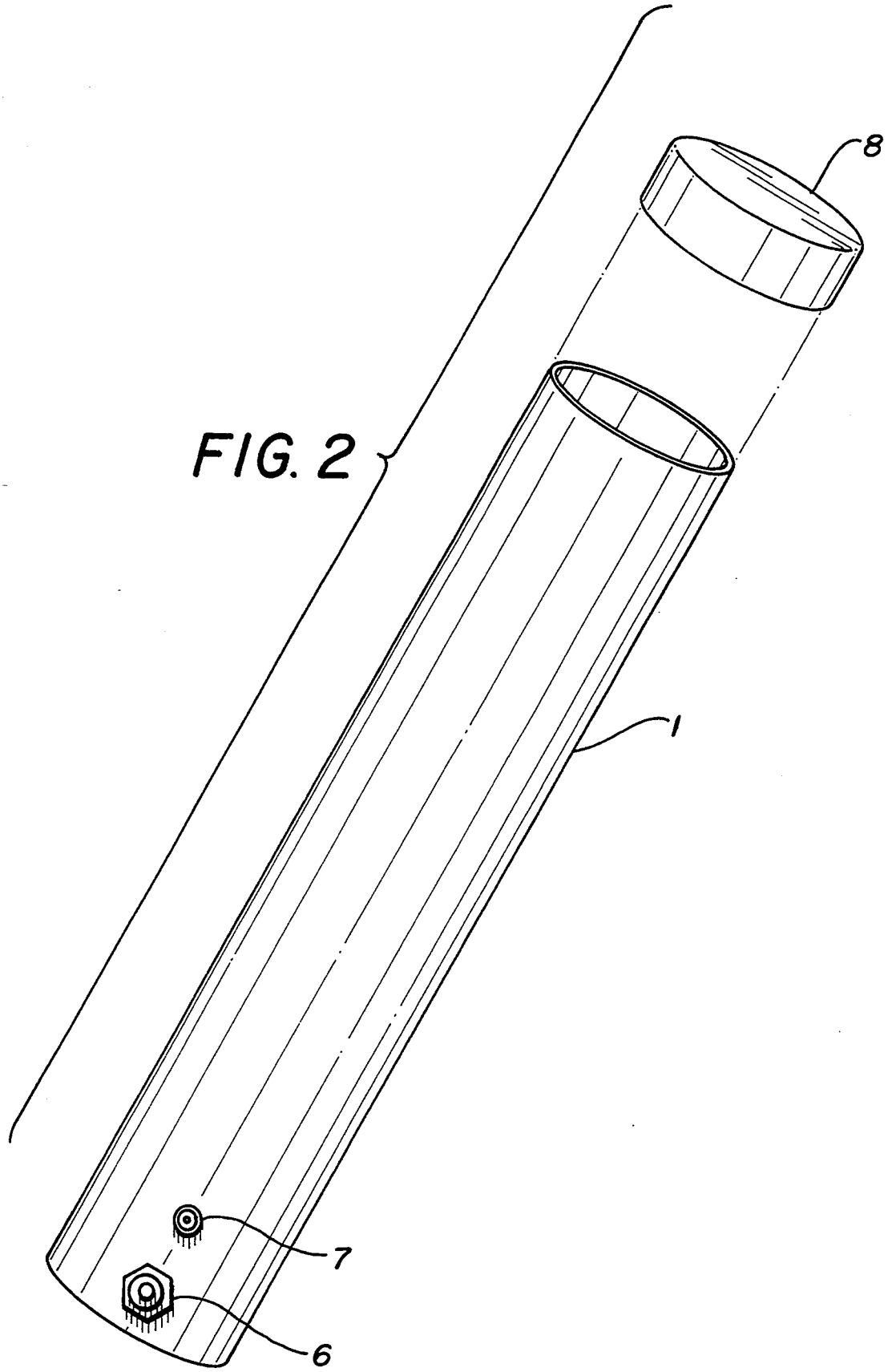
FIG. 2 is a showing of the top housing unit of this device which is designed to hold the power source, the circuitry, the transformer means and the switching means.

In FIG. 2, a more detailed showing of the top housing unit I is shown. In this figure, the switch 6 and the power jack 7 as well as the top cap 9 are also shown. This top housing unit must be transparent in order to provide for passage of light from the interior thereof. The top cap 8 may be removably connected to the bottom housing unit I in a tightly fitted manner or may be attached by screwing on threads provided thereon. An integral circuitry to provide current flow throughout this unit may also be included.

Figure 3:
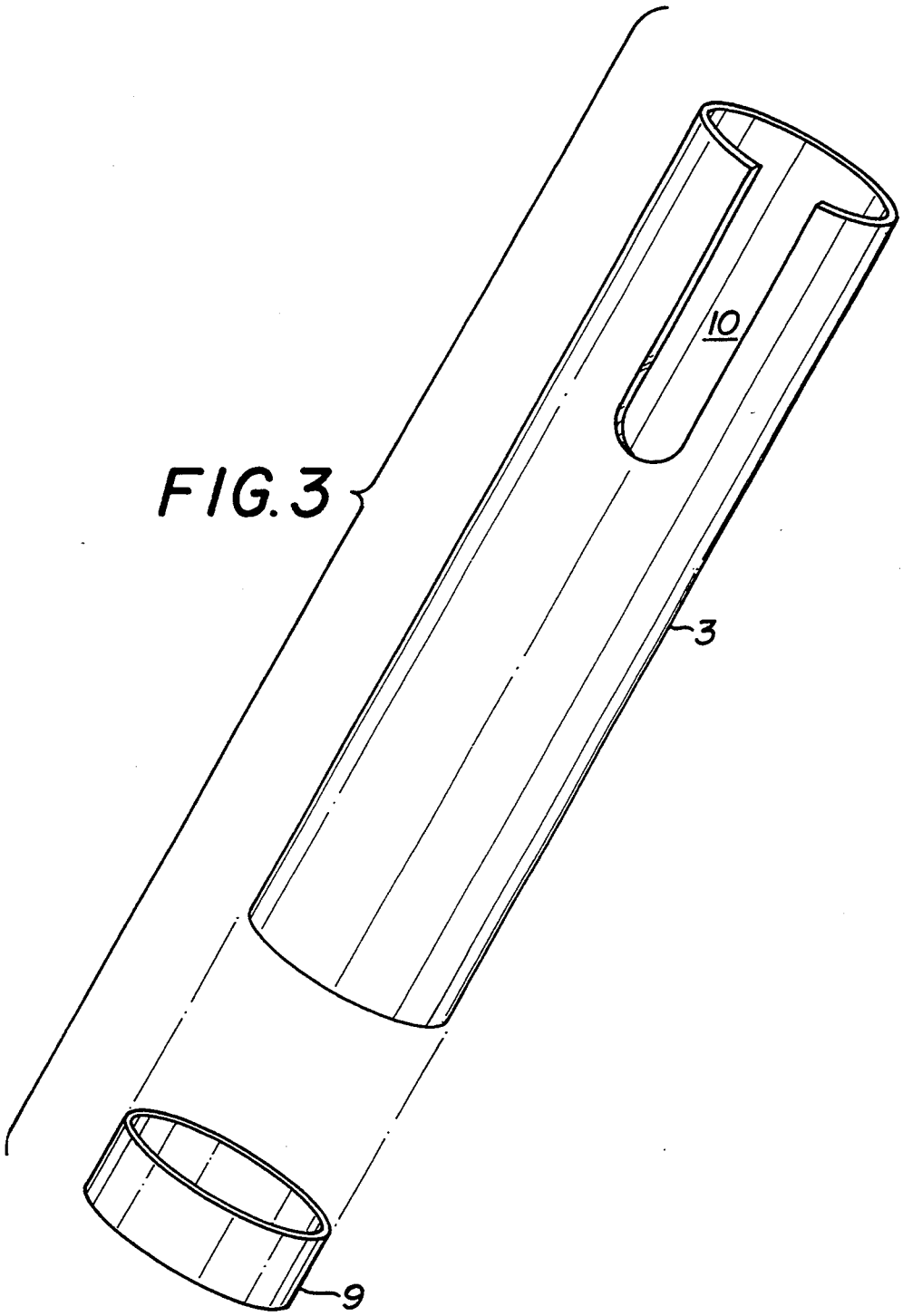
FIG. 3 is a showing of the bottom housing unit of this device which is designed to hold the protected illuminating source.

FIG. 3 is a showing of the bottom housing unit 3 of this invention. The bottom cap 9 is also shown. The bottom housing unit may be manufactured from any of the conventionally know materials including plastics, metals and the like. A locking system shown as an indent 10 may be provided to insure that the top housing unit fits securely within the bottom housing unit. The indent 10 will also fit around the switching means and the external supply jack contained in the top housing unit and may then be secured thereto by any conventional means (e.g. screws, bolts, pop rivets, etc.) Optionally, wires to provide such a circuit may be added to the system as the power supply and transformer are further placed within said bottom housing unit. None of this is shown in detailed within the drawings of this invention, as they represent standard, state of the art and are well-known to those of normal skill therein.

Figure 4:
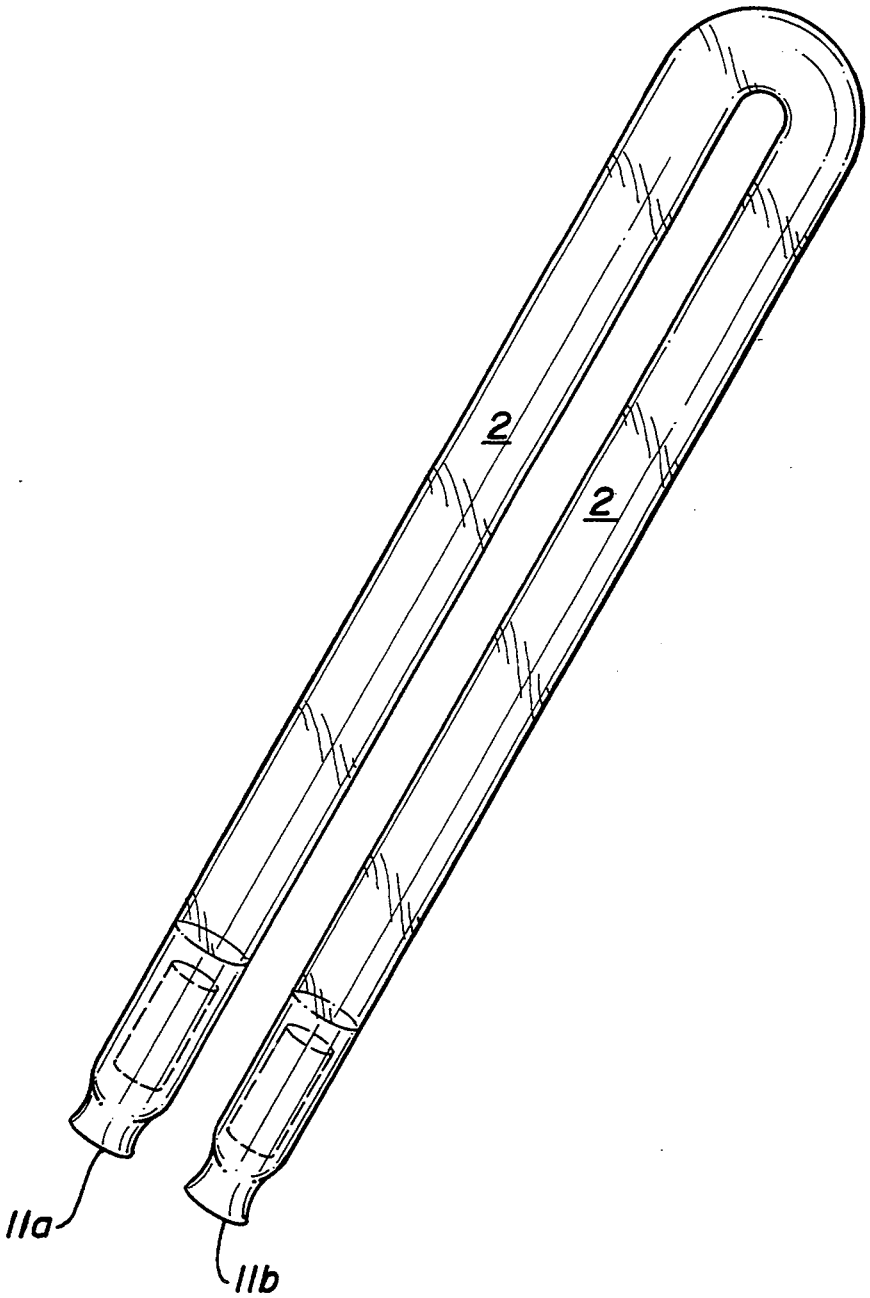
FIG. 4 shows the illumination source which is a "U" shaped glass tube containing the rare gas illumination material.

In FIG. 4, the rare gas containing illumination source 2 is shown. Electrodes 11 a and 11 b are shown attached thereto. These electrodes will then be connected to the secondary side of the transformer 5. From thence, the connection is made to the switching means 6 which is then connected to the ultimate power supply (in this case as batteries 4*a*, 4*b*, 4*c* and 4*d*.

Figure 5:
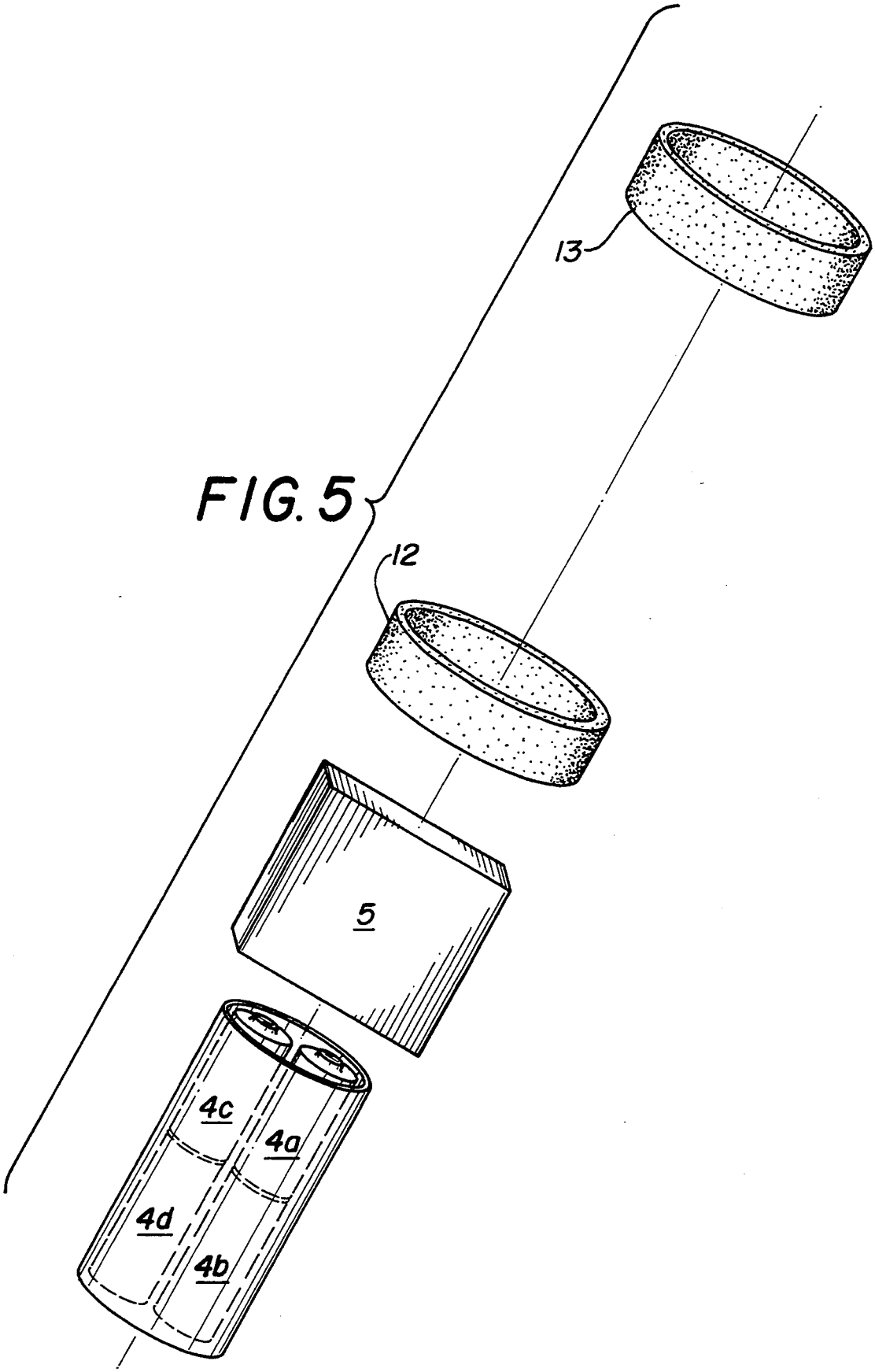
FIG. 5 is a more detailed showing of the contents of the device of this invention.

In FIG. 5, a showing of the various internals of the device of this invention are detailed. In this figure, the power supply is again shown as a series of batteries 4*a*, 4*b*, 4*c*, and 4*d*. These, as mentioned previously, may be rechargeable (preferred) or simply replaceable. The transformer is shown as 5 and two cushioning means 12 and 13 are also shown located at the ends of the curved glass tube which is the lighting source (not shown in this figure). These are shown as foam cushions and are designed to protect the rare gas illumination glass tube (not shown) in the top housing unit. It is important that a protective, cushioning means be employed in order to add strength for the glass tube which is designed to be used under the most rigorous of circumstances.

Figure 6:
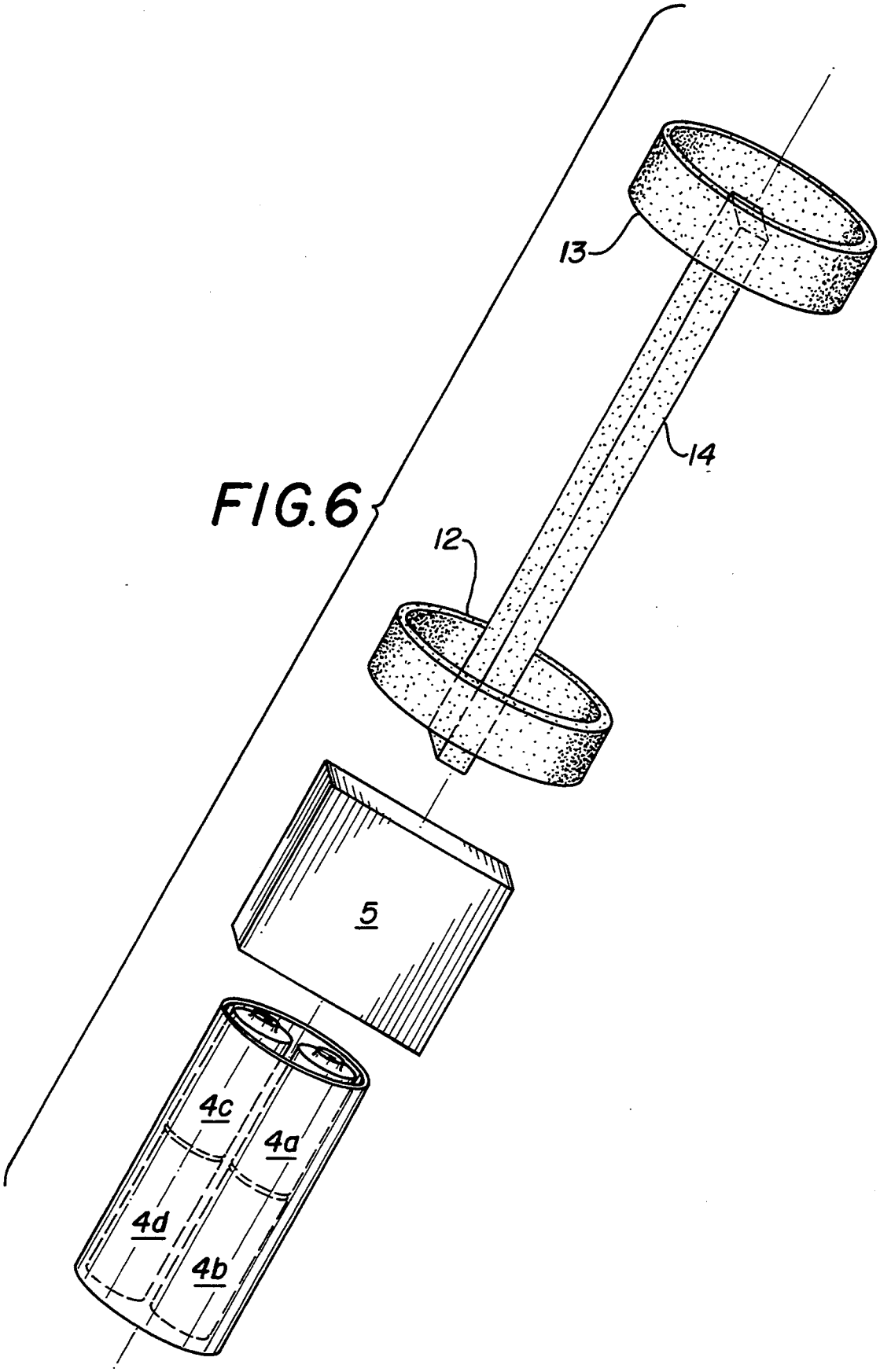
FIG. 6 is another version of FIG. 5 showing an additional foam cushion used to protect the illumination source of FIG. 4

In FIG. 6, the addition of an additional foam cushion 14 is shown to that of FIG. 5. This foam cushion should be present between the "U" shaped, evacuated and rare gas containing glass tube 2 of FIG. 1. This particular mode is the ultimate in protective cushions envisioned in the device of this invention.

Any of the so-called naturally occurring rare gases can be used within the sealed glass tube of the device of this invention. These gases include neon (which will produce a red colored illumination source by itself), helium argon (blue illumination and which may also include a small amount of mercury which is added for brightness), and krypton. When these gasses are placed within a properly prepared, evacuated and sealed tube, a tube which may be coated inside with a light coat of a fluorescent powder to give a specific color to the light emanating therefrom, the light will be bright and can be seen from great distances. The tube will also contain an electrode sealed to each end of the tube. Each electrode is then attached to the output side of the transformer. When further connected to a power supply, the transformer will produce high voltage output which causes the gas to illuminate. This illumination is probably the result of the bombardment of the molecules of the gas by the energy source. This then produces light. I prefer using neon as the rare gas within the element of this invention when the element of this invention is designed for emergency cases (e.g. red color).

The hand-held, rare gas containing illuminating safety device of this invention will radiate at lest five times as much light for a given amount of electrical energy provided as compared to an incandescent light. The brilliance and sparkle with which these luminescent tubes stand out on a rainy and/or foggy night is incredible. Thus, when used as a safety flare or as a means of direction, this device has no peers in the prior art.

The hand-held, rare gas containing illuminating safety device of this invention can be used as a safety light for of emergency vehicles such as ambulances, fire and police vehicles, traffic control and the like. Additionally, this device can be propitiously used by gas, electric, telephone, cable TV, railroads, public service departments in the areas of public works and road maintenance and construction. Also envisioned within the art field which will find use for this device is that of the armed forces including the navy, air force, army, marines and coast guard. These, among others, will find this device highly utile for marking areas of danger or directing traffic or in the event of natural disasters and the like. Also envisioned are those used to direct crowds in the areas of concerts, night clubs, parking attendants, etc. The device of this invention may also be used by the public under any common emergency situation (e.g. disabled vehicles and water craft, for example).

Rare gas containing illumination sources are extremely efficient in terms of energy consumption. The glass tube containing this particular light source can be bent in any shape to conform to the desired device in which it is to be placed. Thus, it is possible to make a "U" shaped source which is particularly useful in the device of this invention, since it provides more of the light source than a simple, straight tube element. The color possibilities are defined only by the type of gas and the fluorescent powder as a coating within the light source. Since rare gas illumination sources consume very little power, they are extremely efficient and are a permanent source of light unless the integrity of the tube is violated. Additionally, these light sources are odorless and produce no fumes, such as those that may be produced by sulfur-containing flares and the like. Additionally, sulfur-containing flares have been associated with and have caused fires the like. The device of this invention has no such danger associated therewith. The light produced by rare gas illumination sources is intense and easy on the eyes. These elements produce a continuous source of light extending over a line or surface. Hence, they cast no sharp shadows. Most other sources of light (e.g. incandescent lights) approximate a point source of light which casts shadows of the object in the path of the rays produced therefrom.

I prefer using a neon rare gas illumination source since it is a readily available gas and plentiful. Additionally, the light produced therefrom (red) is highly useful as a conventional emergency source and readily distinguishable in an emergency situation. In a particularly preferred embodiment, I will prepare a neon rare gas illumination source which consists of a vacuum tight glass tube containing a small amount of neon placed therein. At one end of the tube, an electrode is sealed within the glass and extending outside thereof. At the other end, another such electrode is sealed within the glass and extends outside thereof. These two electrodes are then connected to the secondary side (output) of a power transformer. From there, the connection is through a conventional switching means to a power supply, which may be any of the conventionally known sources of power (e.g. self contained batteries, the 12 V battery of an automobile, or conventional line sources of electricity of AC or DC electricity, for example). As to the transformer, I prefer using a powerful, miniaturized 12 volt transformer made by Bertonee, Inc. of Alberta, Canada. This device will produce from 0.6 amperes to 0.9 amperes over a voltage range of 11 to 14 volts. With a neon rare gas illumination tube of 12 mm in diameter, a length of from 2 to 4 feet can be used with this device and still produce the desired high light output. In my case, I prefer using a length of tube of 24 inches, bent in a "U" shaped configuration and with a diameter of 15 min. However, any diameter from 8 to 18 mm can be used as well. The tube containing the neon light source is placed within a protective, plastic shield. I prefer using a Lexan® shield which is an acrylate produced by the General Electric Co., Schenectady, N.Y. However, any of the conventional, clear plastics can be used to make the shield used to cover this light source. These plastics include the high density polyethlyenes and polypropylenes as well as the terephthalates and polyacrylates, among many others. The power source, switching means (including a "flashing" type switching means) and the transformer, are placed within another tube which makes up the handle of the device of this invention. By using a rechargeable battery source, this device is extremely efficient, can be utilized repeatedly without problems, and is visible during the hours of darkness up to 2,500 feet away. The visibility is 360°. Neon is a particularly useful rare gas since it can be "flashed" successfully because it produces instantaneous light.

I claim:

1. A transparent, portable, hand-held high intensity safety illumination device comprising an interconnected top cylindrical housing unit and bottom cylindrical housing unit, said top housing unit comprising a hollow, cylindrical housing for a rare gas illuminating source, wherein said rare gas is taken from a group consisting of neon, argon, krtypton, and argon mixed with mercury said rare gas illuminating source having a glass tube containing said rare gas and wherein said glass tube is bent in a "U" shaped fashion with a top end and a bottom end, protective cushioning means surrounding said glass tube at both ends thereof, and wherein said bottom housing unit having a circuit means attached to said glass tube in said top unit, a power source connected with said circuit means, through a transformer means, and a switch means for activating said rare gas illuminating source through said circuit means and said power source wherein, said circuit means, said power source, said transformer means, and said switch means are fully contained within said bottom housing unit.

2. The device of claim 1 wherein said power supply is a rechargeable battery source and said device includes a connection point for a DC power supply.

3. The device of claim 1 wherein said switch means has three positions, namely on, off and preset flashing intervals.

4. The device of claim 1 wherein said top housing unit is a durable transparent material.

5. The device of claim 1 wherein said transformer unit is a multipurpose transformer unit.

6. The device of claim 1 wherein said power supply is replaceable.

7. The device of claim 1 wherein said power supply is rechargeable.

8. The device of claim 1 wherein said rare gas illumination material is neon.

* * * * *